US006880496B2

(12) United States Patent
Batzill et al.

(10) Patent No.: US 6,880,496 B2
(45) Date of Patent: Apr. 19, 2005

(54) WATER-COOLED MULTI-CYLINDER INTERNAL-COMBUSTION ENGINE

(75) Inventors: Manfred Batzill, Neuhausen (DE); Falk Schulkowski, Huerth (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 10/678,641

(22) Filed: Oct. 6, 2003

(65) Prior Publication Data

US 2004/0123816 A1 Jul. 1, 2004

Related U.S. Application Data

(63) Continuation of application No. PCT/EP02/03407, filed on Mar. 27, 2002.

(30) Foreign Application Priority Data

Apr. 6, 2001 (DE) ..... 101 17 090

(51) Int. Cl.[7] ..... F01P 7/14
(52) U.S. Cl. ..... 123/41.1; 236/34.5
(58) Field of Search ..... 123/41.1; 236/34.5, 236/101 C

(56) References Cited

U.S. PATENT DOCUMENTS 5,048,751 A 9/1991 DuBois ..... 236/92

FOREIGN PATENT DOCUMENTS

| | | |
|---|---|---|
| DE | 2015546 | 11/1970 |
| DE | 2314301 | 10/1974 |
| DE | 3739494 | 6/1989 |
| DE | 69503795 T2 | 2/1999 |
| EP | 0 933 510 | 8/1999 |
| EP | 1 030 040 | 8/2000 |
| GB | 483 473 | 4/1938 |

*Primary Examiner*—Noah P. Kamen
(74) *Attorney, Agent, or Firm*—Crowell & Moring, LLP

(57) ABSTRACT

A water-cooled multi-cylinder internal-combustion engine having a crankcase and cooling ducts which surround the cylinders and which are acted upon by coolant by way of a pump in a small cooling circuit. For switching over to a large cooling circuit provided with a radiator, a thermostat is provided which is inserted in a thermostat housing. The thermostat housing has a top part provided with coolant connections and a bottom part preferably integrated in the crankcase. An insertion part is inserted in the bottom part of the thermostat housing, which insertion part has at least one opening which is controlled by the thermostatic valve for controlling the flow in the small and the large cooling circuit.

18 Claims, 5 Drawing Sheets

WATER-COOLED MULTI-CYLINDER INTERNAL-COMBUSTION ENGINE

This application is a continuation of PCT Application No. PCT/EP02/03407 filed on Mar. 27, 2002, which claims priority of German Application No. DE 101 17 090.4 filed Apr. 6, 2001.

BACKGROUND AND SUMMARY OF THE INVENTION

The invention relates to a water-cooled multi-cylinder internal-combustion engine. Preferred embodiments of the invention relate to a water-cooled multi-cylinder internal-combustion engine having a crankcase and cooling ducts which surround the cylinders and which are acted upon by coolant by way of a coolant pump in a small cooling circuit, a thermostat being provided for switching over to a large cooling circuit provided with a radiator, which thermostat is inserted in a thermostat housing, the thermostat housing having a top part provided with coolant connection and a bottom part preferably integrated in the crankcase.

From European Patent Document EP 0 933 510 A2, a water-cooled internal-combustion engine is known, in which a thermostat controlling the two cooling circuits is arranged between the two cylinder banks in a thermostat housing surrounding the thermostat. To the extent that it is visible in the drawings, the thermostat housing has a bottom part connected in one piece with a crankcase top half and a thermostat cover to which corresponding inlet and outlet connection pieces are molded. For controlling the two cooling circuits (small cooling circuit—large cooling circuits), corresponding wall sections are provided in the bottom part, by which the corresponding chambers are formed which can be controlled by the thermostat.

It is an object of the invention to develop a housing accommodating the thermostat for a water-cooled multi-cylinder internal-combustion engine, which housing is distinguished by a simple, flow-promoting and weight-optimized construction, which, in addition, requires little space.

The object is achieved by providing a water-cooled multi-cylinder internal-combustion engine having a crankcase and cooling ducts which surround the cylinders and which are acted upon by coolant by way of a coolant pump in a small cooling circuit, a thermostat being provided for switching over to a large cooling circuit provided with a radiator, which thermostat is inserted in a thermostat housing, the thermostat housing having a top part provided with coolant connection and a bottom part preferably integrated in the crankcase, wherein an insertion part is inserted in the bottom part of the thermostat housing, which insertion part has at least one opening which is controlled by a thermostatic valve for controlling the small and the large cooling circuits.

By means of the insertion part suggested according to the invention, water chambers are formed whose openings are monitored by the thermostatic valve. The insertion part is easy to produce, and high-expenditure wall sections, which are normally required in the bottom part of the thermostat housing, can be eliminated.

Additional advantages and advantageous further developments of the invention are contained in the subclaims and in the description.

Other objects, advantages and novel features of the present invention will become apparent from the following detailed description of the invention when considered in conjunction with the accompanying drawings.

DETAILED DESCRIPTION OF THE DRAWINGS

Figure 1:
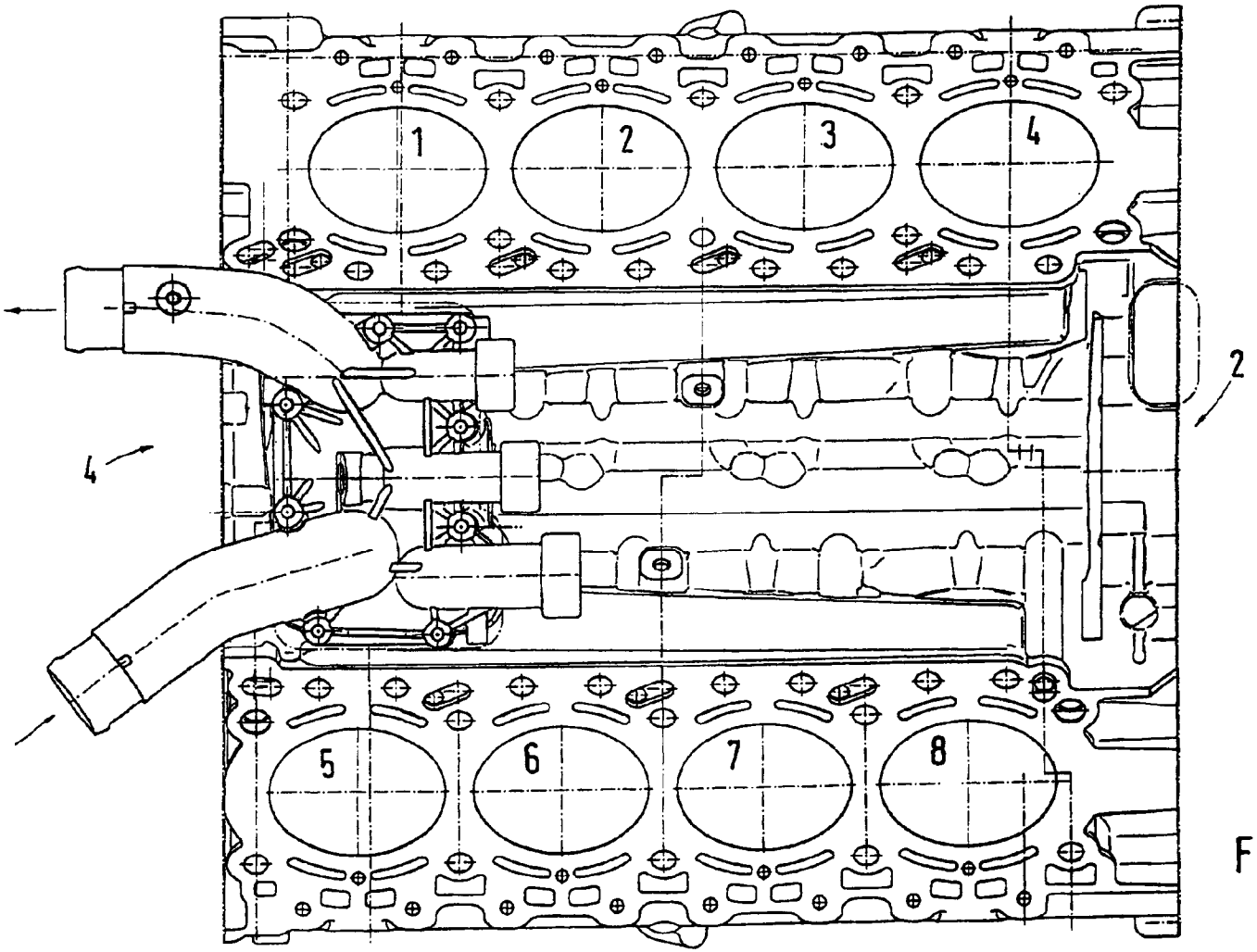
FIG. 1 is a top view of a water-cooled multi-cylinder internal-combustion engine, constructed according to preferred embodiments of the invention.
Figure 2:
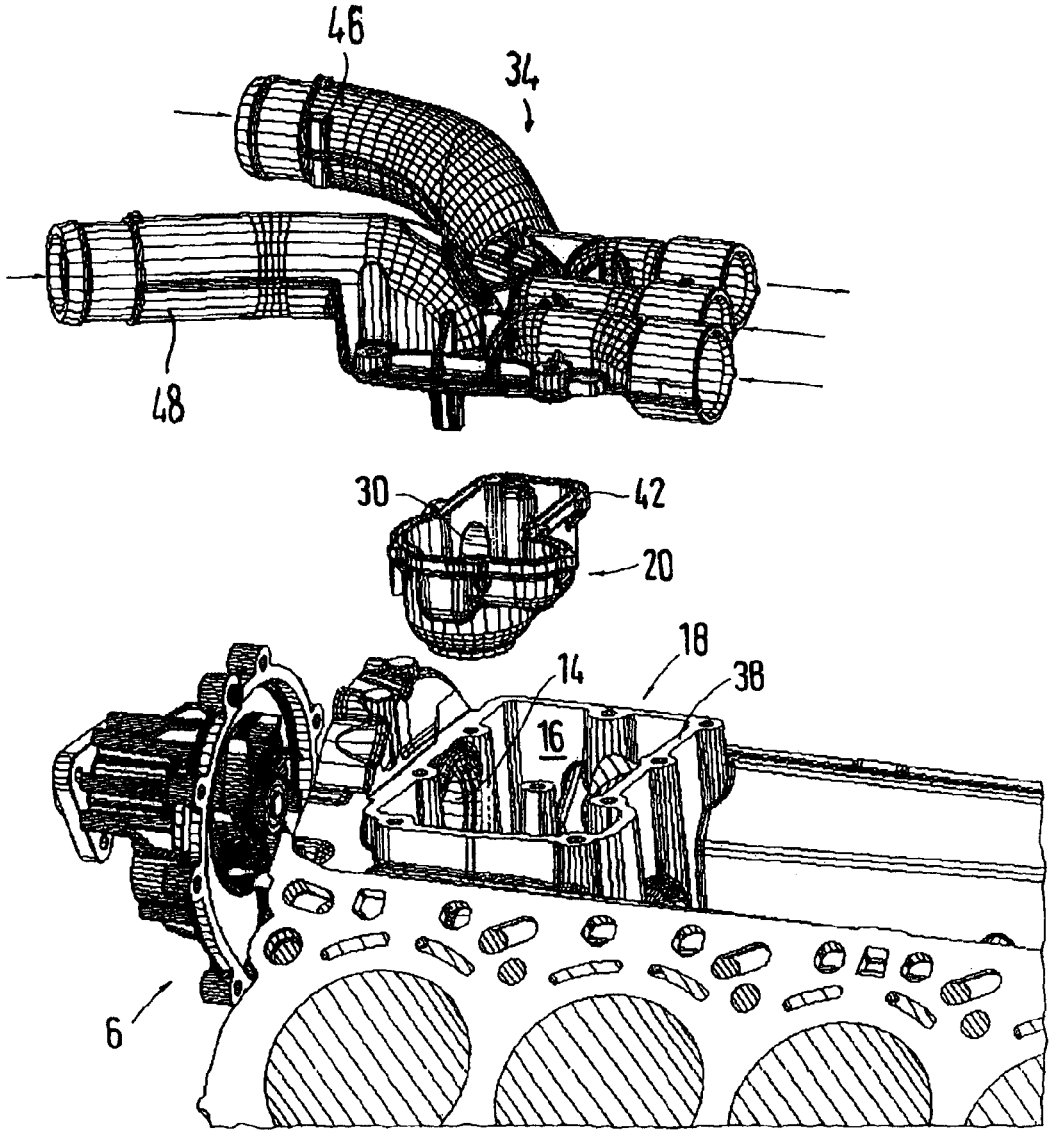
FIG. 2 is an exploded view of an engine assembly with a thermostat housing.
Figure 3:
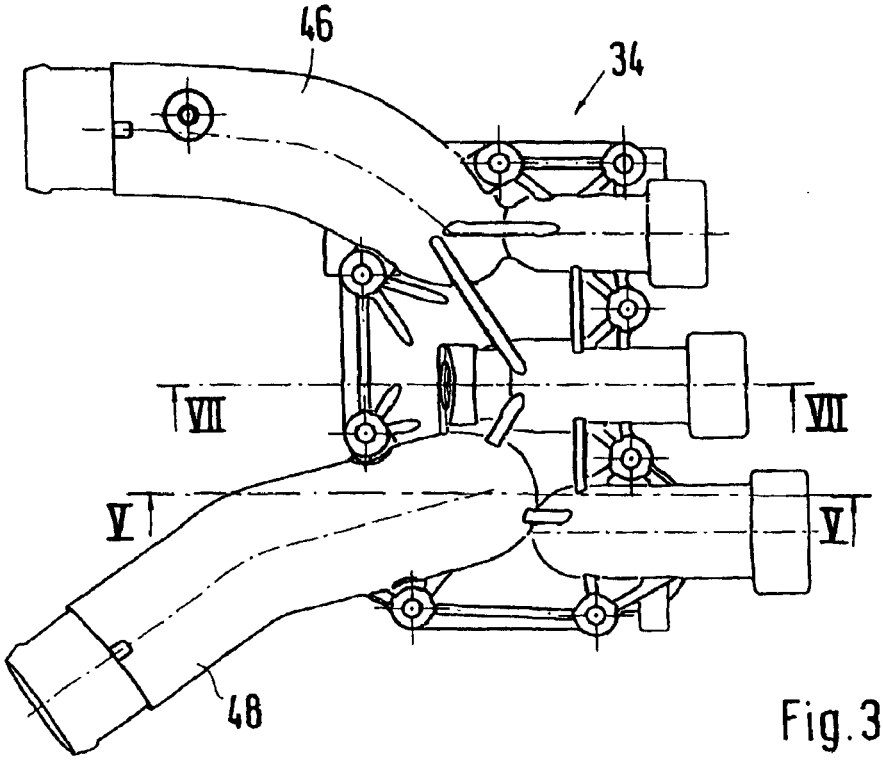
FIG. 3 is a top view of a top part of the thermostat housing of the assembly of FIG. 2.

The crankcase top half 2 of a V-8 engine illustrated in FIG. 1 has a cooling jacket for each cylinder bank row, which cooling jacket encompasses the respective sets of cylinders 1 to 4 and 5 to 8. For generating a restricted flow in the cooling jackets, a water pump 6 is arranged on a front end 4 of the internal-combustion engine. The water pump 6 has a cover part 8 in which the water pump impeller 10 is disposed. Between the two cylinder rows, a housing part 12 of the water pump 6 is arranged which is shaped in one piece with the crankcase top half 2. Coaxially with respect to the water pump impeller 10, an intake connection piece 14 is provided in the housing part 12, which intake connection piece 14 merges into a bottom part 18 of a thermostat housing forming a first coolant return flow chamber 16, in which case the bottom part 18 is shaped in one piece out of the crankcase top half 2.

A thermostat insertion part 20 is inserted into the first coolant return flow chamber 16, which thermostat insertion part 20 is screwed by means of fastening devices, which are not shown, into the bottom part 18 of the thermostat housing. The trough-shaped insertion part 20, which is made, for example, of aluminum diecasting, has a cylindrical opening 22 at its bottom. As will be described in detail in the following, this opening 22 is controlled by a first valve disk 24 of a thermostatic valve 26. In the lateral wall area, the thermostat insertion part 20 has another opening 30 provided with a connection piece 28. In this case, the connection piece 28 is sealingly fitted by way of an O-ring 32 into the intake connection piece 14 of the water pump housing part 12. The thermostat housing is closed off by a top part 34 which is sealed off with its flange surface 36 with respect to the flange surface 38 of the bottom part 18.

Figure 4:
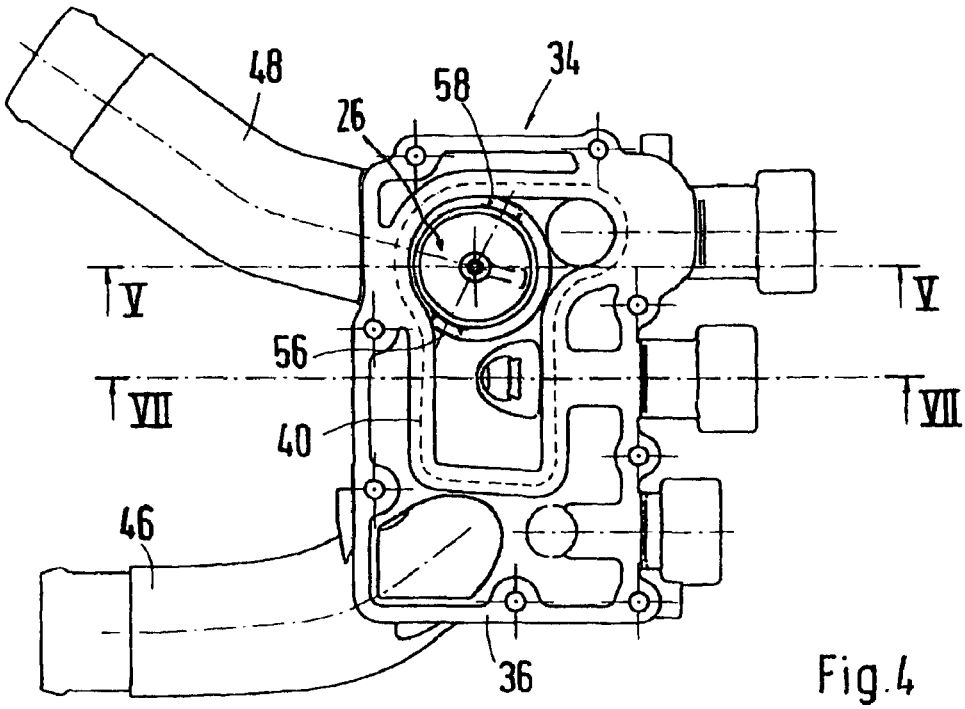
FIG. 4 is a bottom view of the top part of the thermostat housing shown in FIG. 3.

On the underside of the thermostat top part 34, an inner flange surface 40 is provided which extends corresponding to the broken line (see FIG. 4), which is sealed off in the mounted condition with respect to the trough edge 42 of the insertion part 20, and whereby a second coolant return flow chamber 44 is formed in the insertion part 20. The thermostat top part 34 has a connection piece 46 leading to a radiator, which is not shown, which connection piece 46 is connected with the first coolant return flow chamber 16. A second connection piece 48 for the cooling water flowing back from the radiator is connected by way of an opening 50 constructed in the return flow connection piece 48 with the second coolant return flow chamber 44. In this case, the opening 50 is controlled by way of a second valve disk 52 of the thermostatic valve 26. For fastening the thermostatic valve, a holding plate 54 is provided which is fastened to two holding webs 56 and 58 which are cast to the flange side of the thermostat top part 34.

In the following, the switch-over from the small coolant circuit to the large coolant circuit, which is known per se and in which a corresponding radiator is included, will be explained by means of the present embodiment.

Figure 5:
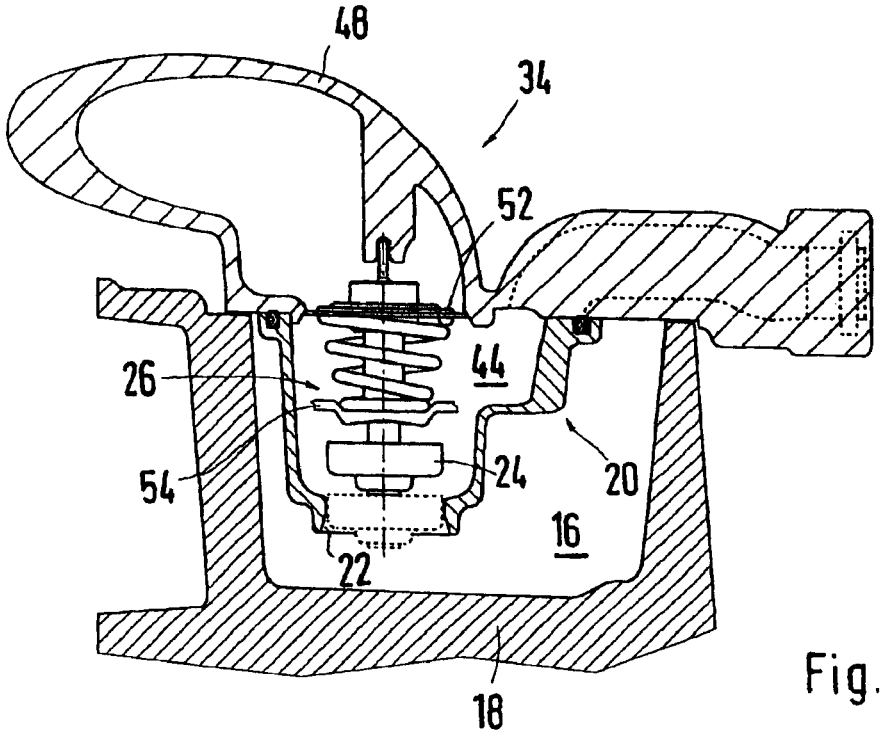
FIG. 5 is a sectional view along Line V—V in FIG. 3 showing the top and bottom parts of the thermostat housing and the insert of FIG. 2 in an assembled condition with a thermostatic valve.

In the warm-up phase of the engine, the small coolant circuit is activated. For this purpose, the opening 22 provided in the bottom area of the insertion part 20 is opened up by the valve disk 24 (see FIG. 5), so that the coolant flowing back from the cylinder bank rows flows from the first coolant return flow chamber 16 into the second return flow chamber 44. Since the opening 50 is closed by the second valve disk 52, by way of the intake connection piece 14 of the water pump 6, the coolant is delivered by way of the water pump impeller 10 into a coolant pipe 60, and flows from there, in turn, to the cooling jackets arranged in the two cylinder bank rows.

Figure 6:
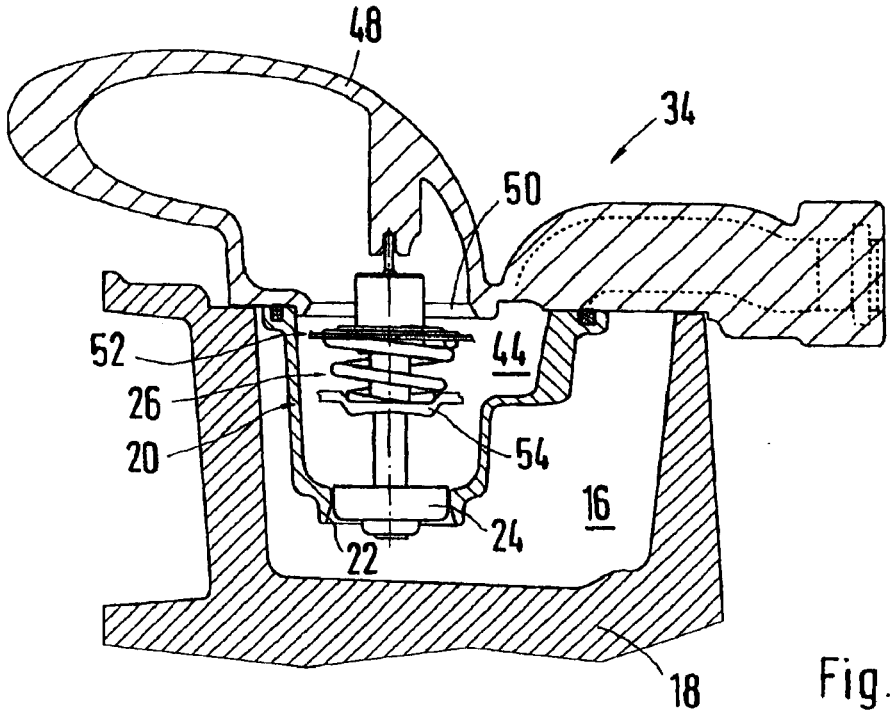
FIG. 6 is a sectional view similar to FIG. 5 along Line V—V in FIG. 3 showing a second position of the thermostatic valve.
Figure 7:
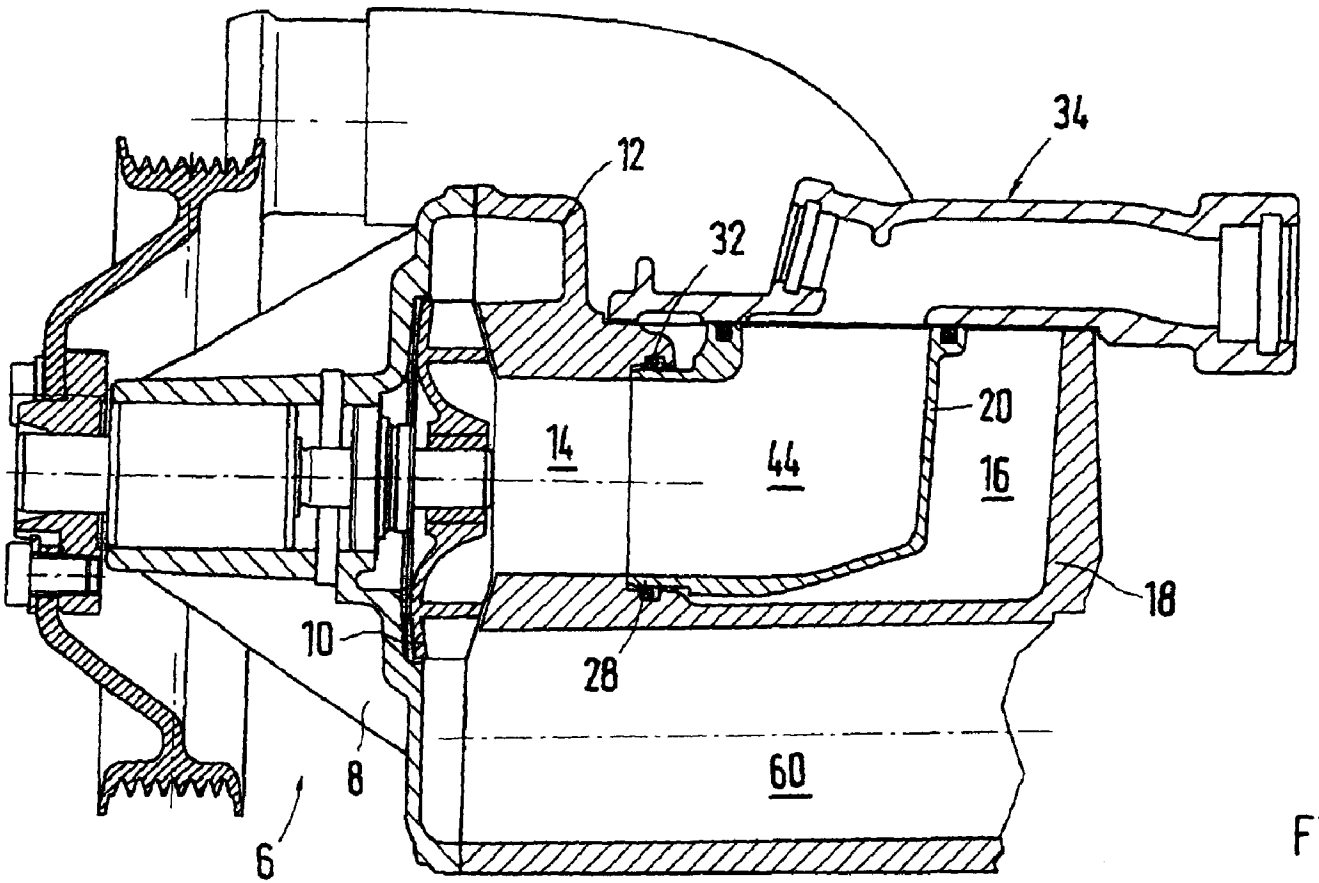
FIG. 7 is a sectional view along Line VII—VII in FIG. 3 showing the top and bottom parts of the thermostat housing, the insert and the water pump of FIG. 2 in an assembled condition.

In addition to the above-described small coolant circuit, after the reaching of the operating temperature of the internal-combustion engine, a switch-over takes place to the large coolant circuit, in which the radiator circuit is included. In this case, as illustrated in FIG. 6, the opening 22 is closed by the first valve disk 24, while the opening 50 controlled by the second valve disk 52 is opened up for the radiator return flow (return flow connection piece 48). The coolant flowing back from the cylinder banks arrives in the first return flow chamber 16 and is then guided to the radiator by way of the forward flow connection piece 46. By way of the return flow connection piece 48, the coolant cooled by the radiator flows back into the second return flow chamber 44 and is guided from there, again by way of the intake connection piece 14 of the water pump 6 and by means of the water pump impeller 10, by way of the coolant pipe 60 to the cylinder banks.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Water-cooled multi-cylinder internal-combustion engine having a crankcase and cooling ducts which surround the cylinders and which are acted upon by coolant by way of a coolant pump in a small cooling circuit, a thermostat being provided for switching over to a large cooling circuit provided with a radiator, which thermostat is inserted in a thermostat housing, the thermostat housing having a top part provided with coolant connections and a bottom part integrated in the crankcase, wherein an insertion part is inserted in the bottom part of the thermostat housing, which insertion part has at least one opening which is controlled by a thermostatic valve for controlling the small and the large cooling circuits, and wherein the bottom part of the thermostat housing is cast in a crankcase top half together with a pump housing.

2. Water-cooled multi-cylinder internal-combustion engine according to claim 1, wherein the insertion part has an opening provided with a connection piece, the connection piece engaging in an intake connection piece which leads to a suction side of the coolant pump.

3. Water-cooled multi-cylinder internal-combustion engine according to claim 2, wherein a first coolant return flow chamber is constructed between the insertion part and the bottom part of the thermostat housing.

4. Water-cooled multi-cylinder internal-combustion engine according to claim 3, wherein the insertion part is trough-shaped and is closed off toward the top by the top part of the thermostat housing, and wherein a second return flow chamber is formed which is connected with the first return flow chamber by way of an opening controlled by the thermostatic valve.

5. Water-cooled multi-cylinder internal-combustion engine according to claim 4, wherein the top part of the thermostat housing is provided with a radiator forward flow connection piece and with a radiator return flow connection piece, wherein the forward flow connection piece is connected with the first return flow chamber, wherein an opening of the radiator return flow connection piece is connected with the second return flow chamber, and wherein the opening of the return flow connection piece is controlled by a second valve disk of the thermostat.

6. Water-cooled multi-cylinder internal-combustion engine according to claim 2, wherein a crankcase top half accommodates two cylinder banks which are arranged in a V-shape with respect to one another and between which the bottom part of the thermostat housing is cast in on one face.

7. Water-cooled multi-cylinder internal-combustion engine according to claim 1, wherein a first coolant return flow chamber is constructed between the insertion part and the bottom part of the thermostat housing.

8. Water-cooled multi-cylinder internal-combustion engine according to claim 7, wherein the insertion part is trough-shaped and is closed off toward the top by the top part of the thermostat housing, and wherein a second return flow chamber is formed which is connected with the first return flow chamber by way of an opening controlled by the thermostatic valve.

9. Water-cooled multi-cylinder internal-combustion engine according to claim 8, wherein the top part of the thermostat housing is provided with a radiator forward flow connection piece and with a radiator return flow connection piece, wherein the forward flow connection piece is connected with the first return flow chamber, wherein an opening of the radiator return flow connection piece is connected with the second return flow chamber, and wherein the opening of the return flow connection piece is controlled by a second valve disk of the thermostat.

10. Water-cooled multi-cylinder internal-combustion engine according to claim 7, wherein a crankcase top half accommodates two cylinder banks which are arranged in a V-shape with respect to one another and between which the bottom part of the thermostat housing is cast in on one face.

11. Water-cooled multi-cylinder internal-combustion engine according to claim 8, wherein a crankcase top half accommodates two cylinder banks which are arranged in a V-shape with respect to one another and between which the bottom part of the thermostat housing is cast in on one face.

12. Water-cooled multi-cylinder internal-combustion engine according to claim 9, wherein a crankcase top half accommodates two cylinder banks which are arranged in a V-shape with respect to one another and between which the bottom part of the thermostat housing is cast in on one face.

13. Water-cooled multi-cylinder internal-combustion engine according to claim 1, wherein a crankcase top half accommodates two cylinder banks which are arranged in a V-shape with respect to one another and between which the bottom part of the thermostat housing is cast in on one face.

14. A cooling system of a water-cooled multi-cylinder internal-combustion engine having a crankcase, the cooling system comprising cooling ducts which surround the cylinders and which are acted upon by coolant by way of a coolant pump in a small cooling circuit, a thermostat provided for switching over to a large cooling circuit provided with a radiator, which thermostat is inserted in a thermostat housing, the thermostat housing having a top part provided with coolant connections and a bottom part integrated in the crankcase, and an insertion part insertable in the bottom part of the thermostat and comprising at least one opening which is controlled in use by a thermostatic valve for controlling the small and the large cooling circuits, wherein the bottom part of the thermostat housing is cast in a crankcase top half together with a pump housing.

15. The cooling system according to claim 14, wherein the insertion part has an opening provided with a connection piece, the connection piece engaging in an intake connection piece which leads to a suction side of the coolant pump.

16. The cooling system according to claim 14, wherein a first coolant return flow chamber is constructed between the insertion part and the bottom part of the thermostat housing.

17. The cooling system according to claim 16, wherein the insertion part is trough-shaped and is closed off toward the top by the top part of the thermostat housing, and wherein a second return flow chamber is formed which is connected with the first return flow chamber by way of an opening controlled by the thermostatic valve.

18. The cooling system according to claim 14, wherein said insertion part is an aluminum die cast part.

* * * * *